US006477337B1

(12) United States Patent
Suh

(10) Patent No.: US 6,477,337 B1
(45) Date of Patent: Nov. 5, 2002

(54) ARTIFICIAL OLFACTORY SYSTEM AND METHODS FOR MEDIA SENSING AND IDENTIFICATION

(75) Inventor: John W. Suh, Palo Alto, CA (US)

(73) Assignee: Xerox Corporation, Stamford, CT (US)

( * ) Notice: Subject to any disclaimer, the term of this patent is extended or adjusted under 35 U.S.C. 154(b) by 36 days.

(21) Appl. No.: 09/721,730

(22) Filed: Nov. 27, 2000

(51) Int. Cl.[7] ..... G03G 15/00
(52) U.S. Cl. ..... 399/45
(58) Field of Search ..... 399/45, 125, 390; 428/85, 402; 422/4

(56) References Cited

U.S. PATENT DOCUMENTS 4,882,220 A * 11/1989 Ono et al. ..... 428/240
5,243,394 A * 9/1993 Matsuno et al. ..... 399/125
5,970,300 A 10/1999 Acquaviva ..... 399/341
5,975,675 A * 11/1999 Kim ..... 347/20
6,090,344 A * 7/2000 Yamauchi et al. ..... 422/4
6,322,033 B1 * 11/2001 Lee ..... 428/85 X

FOREIGN PATENT DOCUMENTS

JP 4154566 * 5/1992

* cited by examiner

*Primary Examiner*—Fred L Braun
(74) *Attorney, Agent, or Firm*—Oliff & Berridge, PLC

(57) ABSTRACT

An encoded sheet material and method for encoding a sheet of material that has a first surface, a second surface disposed opposite the first surface and an edge extending between the first and second surfaces and peripherally about the sheet of material. The first surface, the second surface and/or the edge has one or more exudant arranged on it to encode information about at least one characteristic of the sheet of material and/or about an image carried on the sheet of material. A sheet processing apparatus uses the encoded sheet material and includes an exudant sensing device and a processor. The exudant sensing device senses the one or more exudants, their location and/or their concentration. The processor communicates with the exudant sensing device and causes the sheet processing apparatus to process the sheet of material based upon the sensed one or more exudants, their location and/or their concentration.

41 Claims, 6 Drawing Sheets

ARTIFICIAL OLFACTORY SYSTEM AND METHODS FOR MEDIA SENSING AND IDENTIFICATION

BACKGROUND OF THE INVENTION

1. Field of Invention

This invention is directed to systems and methods for sensing and identifying information about recording media or other material.

2. Description of the Related Art

Many different types of recording devices are available in the market place. Such recording devices include photocopying machines, laser, ink jet and dot-matrix printers, facsimile machines and offset printing presses. Each of these recording devices can use one or more types of recording media in the form of sheet material. Photocopying machines, for example, form images on many different types of paper, as well as many different types of plastic transparencies. Also, photocopying machines can form images on recording media of various sizes. For instance, photocopying machines can use recording media having various sizes, such as 8½"×11", 8½×14" and A4 sizes.

Even with the more sophisticated photocopying machines, little information regarding the type of recording media being used is provided. As suggested above, the user can select one of a variety of sizes of the recording media upon which an image is to be formed. Usually, sensors in each source tray provide size information that is displayed on a display positioned in the console of the photocopying machine. Less sophisticated photocopying machines have source trays that are sized to accommodate only one particular size of the recording media.

Thus, it is possible that the user can determine the size of the recording media by viewing the console of the photocopying machine. Otherwise, in order for the user to ascertain any other information regarding the recording media, the user must ascertain this information on the user's own accord. Likewise, other apparatus, such as laser printers, facsimile machines, ink jet printers and the like, similarly have limited abilities to automatically determine information about the recording media being used. Such information includes the size of the recording media, the material forming the recording media, the quality of the recording media, any surface treatments or coatings provided on the recording media, the density or weight of the recording media or the like.

Likewise, many different techniques for embedding information about the image formed on the recording media are known. Such known techniques including digital watermarking, data glyphs and the like. However, each of these known systems requires manipulation of the image data used to form the image on the recording media.

SUMMARY OF THE INVENTION

This invention provides systems and methods for obtaining information about recording media and/or images on a sheet of recording media by sensing one or more chemical compounds released from the recording media and/or images on a recording media.

This invention separately provides systems and methods that use artificial olfactory sensors to detect information about recording media and/or images on a recording media.

This invention separately provides systems and methods for tagging recording media with one or more sensible chemical compounds.

This invention separately provides systems and methods for tagging recording media with one or more sensible chemical compounds based on information carried by the recording media.

This invention separately provides systems and methods for tagging recording media by using toner materials that contain one or more chemical compounds. detectable using an artificial olfactory system.

In various exemplary embodiments of the systems and methods according to this invention, an edge or a surface of a sheet of recording media is provided with one or more chemical compounds that are exuded from the recording media, where the exudate from the recording media can be sensed and/or detected. In various exemplary embodiments, the one or more chemical compounds can be embedded within the media or arranged on the surface or the edge of the recording media to encode information about the recording media and/or images on a recording media.

Various other exemplary embodiments of the systems and methods according to this invention include a media processing apparatus. The media processing apparatus includes an exudate sensing or detecting device and a processor. The media processing apparatus performs an operation on the media, such as forming an image on the media or creating an electronic image of an image carried by the media. However, it should be appreciated that any known or later developed operation that could be performed on or relative to the media could be performed by the media processing apparatus.

The media has one or more chemical compounds embedded within the media or on a surface or an edge of the media that exude material from the media. In various exemplary embodiments, the particular chemical compounds exuded by the media provide information about the media or about an image formed on the media. In various other exemplary embodiments, locations of the one or more chemical compounds embedded within the media or on the surface or the edge of the media form a code containing information about the media and/or the image carried by the media. In various other exemplary embodiments, both the combination of one or more chemical compounds and their location, embedded within the media or on the surface and/or edge of the media, encodes the information about the media and/or the image carried by the media. The exudate sensing device senses the chemical compounds exuded from the media and/or detects the locations where the one or more compounds are exuded by the media.

A processor communicates with the exudate sensing or detecting device and extracts the information from the sensor signals generated by the exudate sensing or detecting device. The media processing apparatus process the media based upon the extracted information.

Various exemplary embodiments of the systems and methods of this invention include an exudate sensing system that detects the type, quantity and/or spatial distribution of the one or more chemical compounds and/or a desktop or handheld scanner and/or tagger that allows a user to encode information onto, and/or decode information from the media. Using one or more specific chemical compounds that are embedded in or applied to a document based on the content and/or source of the document allows the authenticity of a document to be determined. In various exemplary embodiments, the one or more chemical compounds do not affect the electromagnetic properties of the recording media. Thus, the one or more chemical compounds can be used to create a unique "signature" that is virtually invisible to a device that senses the electromagnetic properties of the sheet or material, such as the ability of the sheet of material to reflect visible light. For example, paper money can be coded with one or more exudable chemical compounds. Whereas image and color can be duplicated to some degree, it may be difficult to duplicate an embedded and coded chemical signature.

Conventional copying and/or printing systems are presently limited to optically automatically detecting information about the recording media in the sheet feed or storage stacks. However, optical sensing is limited to non-image areas of the recording sheet and/or cannot be visible or affect the ability of the recording sheet to record an image. For some systems, such as large-scale plotters, it is necessary to know what kind of media is being used so that optimal print quality can be achieved. A exudate-based system enables copying and/or printing systems to detect media type, using non-optical techniques.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
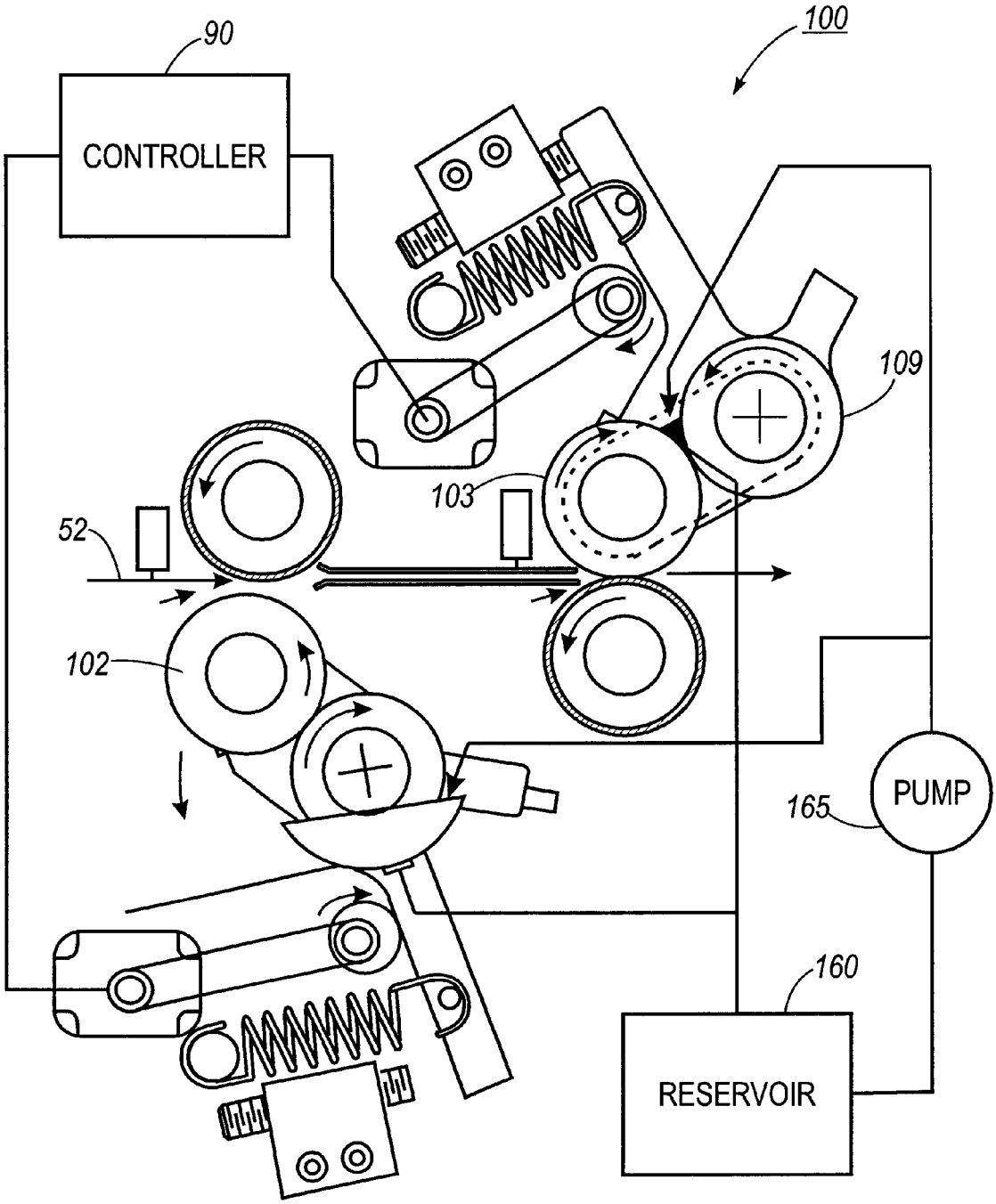
FIG. 1 is a detailed elevation side view of a conventional apparatus for applying a human-sensible scent to paper in an image forming device.

FIG. 1 illustrates a conventional printing apparatus 100 that prints images onto sheets and that includes a conditioner that scents a sheet. For example, the sheet could be a page of a magazine on which a particular fragrance is advertised. As shown in FIG. 1, a fluid that contains a human-sensible scent is provided in a reservoir 160. The fluid is transferred by a pump 165 and a hydrophilic, donor-like roll 102 and is deposited onto the sheet 52 using a nip that is engaged only when a sheet is to be scented. In this printing apparatus 100, the applied scent is discernible to human beings. Other than the odor associated with the scent, no other information is contained in the scent. That is, the scent is provided solely for its own sake, and does not represent information of any kind. This apparatus 100 is described in greater detail in U.S. Pat. No. 5,970,300 to Acquaviva, incorporated herein by reference in its entirety.

Figure 2:
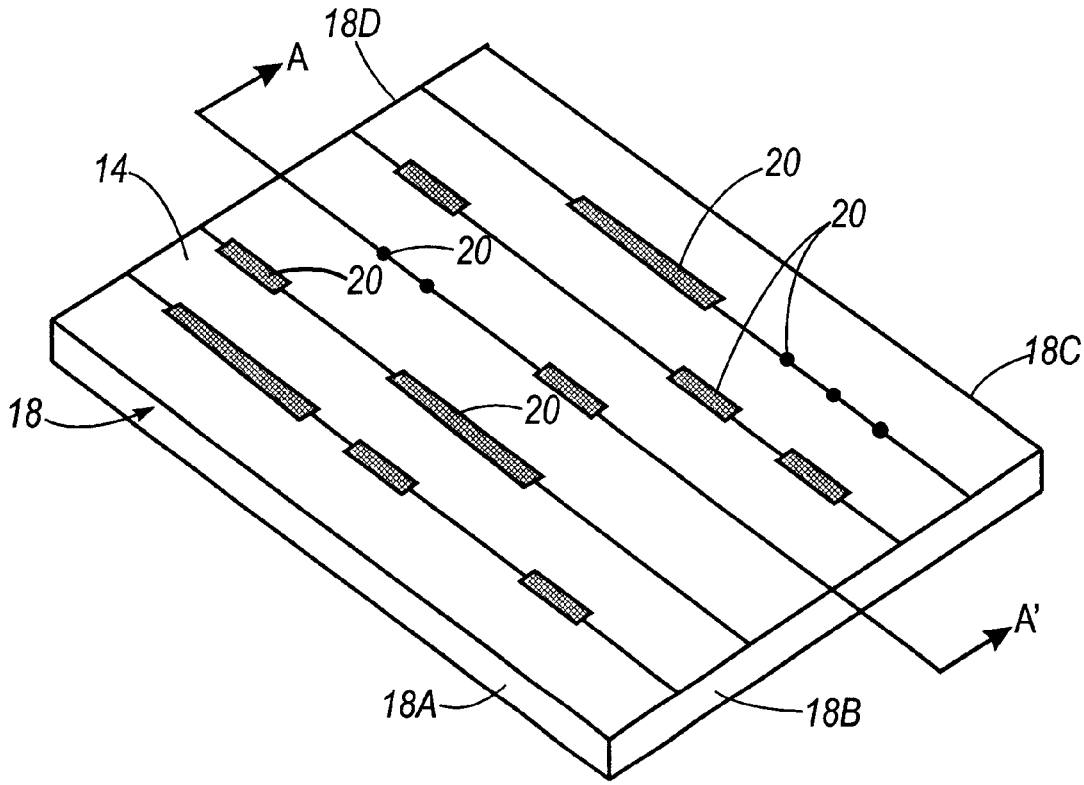
FIG. 2 is a perspective view of one exemplary embodiment of a recording media having a plurality of surface regions containing one or more exudable chemical compounds according to this of the invention.
Figure 3:
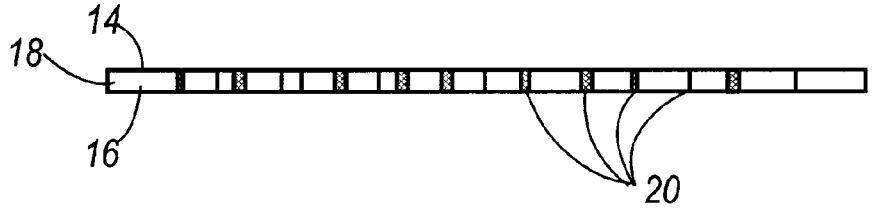
FIG. 3 is side elevational view of one exemplary embodiment of a recording media having a plurality of edge regions containing one or more exudable chemical compounds according to this invention.

As shown in FIGS. 2 and 3, a sheet 12 of recording media has a first surface 14 and a second surface 16 opposite the first surface 14. Although, the following descriptions are directed to a sheet of recording media, it should be appreciated that the system and methods described below may be practiced with any known or later-developed material of any dimension, size, shape, composition or usefulness. Thus, the description of recording media used in an image forming apparatus is exemplary and is not intended to limit the scope of the invention. The sheet 12 includes an edge 18 that extends between the first surface 14 and the second surface 16 and extends peripherally around the sheet 12. As shown in FIG. 2, in various exemplary embodiments according to this invention, one or more locations 20 of the first surface 14 of the sheet 12 each contain one or more exudable chemical compounds.

The sheet 12 also includes a plurality of the edges 18. As shown in FIG. 2, sheet 12 includes four edge portions, 18*a*–18*d*. As shown in FIG. 3, in various exemplary embodiments according to this invention, each of the edge portions 18*a*–18*d* could have one or more exudants formed on one or more portions of that edge 18*a*–18*d*. If desired, each of the four edge portions 18*a*–18*d* can include identical exudant. However, in various other exemplary embodiments according to this invention, identical patterns of the one or more exudants can be formed on opposing edge portions, such as the opposing edge portions 18*a* and 18*c*, or the opposing edge portions 18*b* and 18*d*. Furthermore, in various other exemplary embodiments according to this invention, exudants can be placed on each of the edge portions 18*a*–18*d*. Additionally, in various exemplary embodiments according to this invention, the one or more exudants on each edge 18*a*–18*d*can be different from the one or more exudants on the other edges 18*a*–18*d*.

Figure 7:
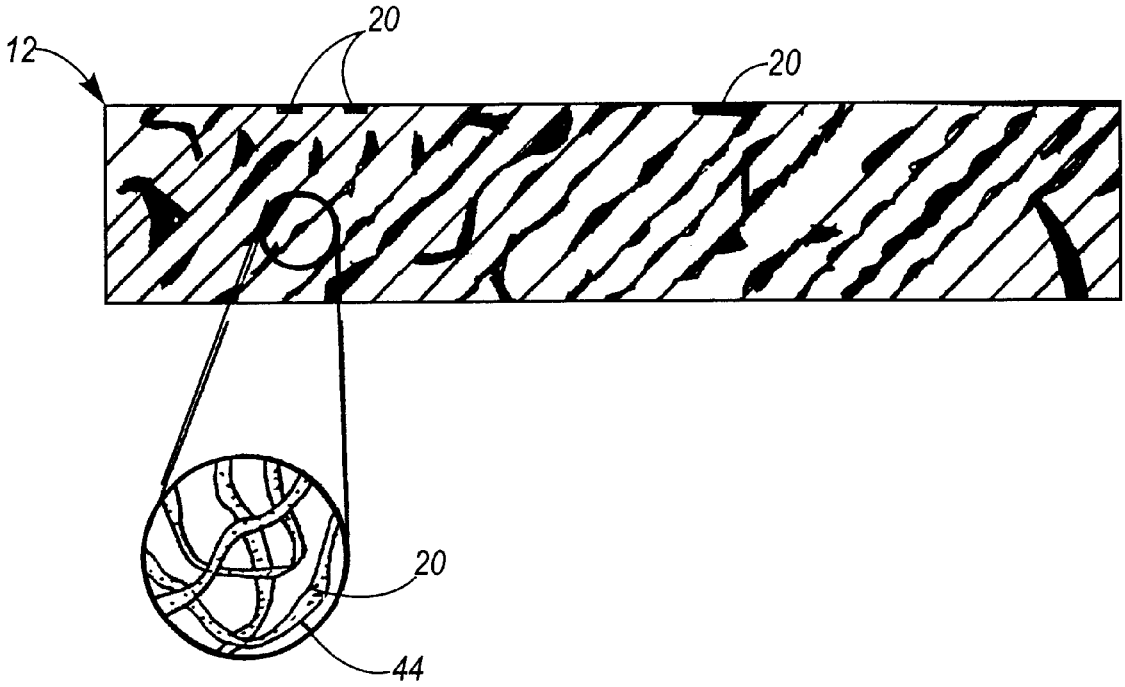
FIG. 7 is a side elevational view of one exemplary embodiment of a recording meida having a plurality of fibers embedded with one or more exudable chemical compounds.

In various other exemplary embodiments according to this invention, the exudant may be embedded into the material forming the sheet of recording media 12. As shown in FIG. 7, the sheet of recording media 12 that is composed of a fibrous material 44 has exudant molecules embedded in the fibers. In various other exemplary embodiments, the molecules may be embedded into the structure of any material used to form the sheet of recording media 12. The embedded exudant may be used alone or in combination with one or more exudants formed on the surfaces 14 and/or 16 of the sheet of recording media 12.

In various exemplary embodiments, each exudable chemical compound is associated with a distinct characteristic of the sheet of recording media 12. In this case, the particular location 20 at which each exudable chemical compound is placed on the sheet of recording media 12 is relatively unimportant, so long as a sensing or detecting device according to this invention is able to detect the presence of the exudable chemical compound, or, when the exudable chemical compound is not detected, the failure of the sensing device to detect the exudable chemical compound can be reliably interpreted as meaning that the exudable chemical compound is not present in the sheet of recording media 12. Alternatively, the exudable chemical compound may be embedded throughout the media 12. Thus, in this case, each exudable chemical compound is associated with a different characteristic of the sheet of recording media 12.

In various other exemplary embodiments, each location 20 is associated with a different characteristic of the sheet of recording media 12. In this case, each such location 20 may include a combination of any number of exudable chemical compounds. In this case, the particular value for the characteristic associated with a particular location 20 can be encoded by the combination of exudable chemical compounds applied to that location 20. It should be appreciated that, in this case, any known or later developed scheme for directly or indirectly representing a particular value for a particular characteristic of the sheet of recording media and/or the image carried by the sheet of recording media 12 using the combination of exudable chemical compounds can be used. For example, in one exemplary embodiment, the information can be encoded based on a binary sorting algorithm, where the sorting is performed based on whether or not each implemented exudable chemical compound is present or not at a particular location 20 of the sheet of recording media 12. Alternatively, in various other exemplary embodiments, each combination of one or more exudable chemical compounds could represent a specific numerical value. The particular characteristics can have numerical values. In this case, the specific numerical value is directly represented by the particular combination of one or more exudable chemical compounds. If the particular characteristic is not numeric, the combination of numerical values can act as a pointer to an entry in a look-up table that contains the various potential values for the characteristic associated with a particular location 20. Finally, in various other exemplary embodiments, each combination of one or more exudable chemical compounds could represent a fixed non-numeric value.

In various other exemplary embodiments, each characteristic of the sheet of recording media 12 is associated with a plurality of the locations 20. This may allow the total number of distinct exudable chemical compounds to be reduced, but could require more surface area of the sheet of recording media 12 to be dedicated to encoding the information about the sheet of recording media 12 and/or the image carried by the sheet of recording media 12. Again, it should be appreciated that any known or later developed encoding scheme can be used to encode information into the one or more exudable chemical compounds and the plurality of locations 20 that can each be associated with each characteristic of the sheet of recording media 12.

It should be appreciated that, as shown in FIG. 2, the information about the particular characteristics of the sheet of recording media 12 and/or the usage carried by the sheet of recording media 12 can be the locations 20 and particular exudable chemical compounds applied to the locations 20. Alternatively, the information about the particular characteristics of the sheet of recording media 12 and/or the image carried by the sheet of recording media 12 can be encoded into the extent of the particular locations 20 that the one or more exudable chemical compounds have been applied to in one or more directions along the edges and/or surface of the sheet of recording media 12.

It should also be appreciated that the exudable chemical compounds can be either visible or indiscernible by the unaided human eye. Alternatively, the exudable chemical compounds can be visible when viewed under specific lighting conditions, such as polarized light, light of a specific wavelength, or the like, or when viewed through one or more viewing aids, such as night vision goggles, infrared goggles or the like. However, it should be appreciated that, in general, it is generally more desirable that the exudable chemical compounds are not visible, at least to the unaided human eye, for aesthetic and/or security reasons.

Similarly, it should be appreciated that the exudable chemical compounds can be either discernible or not discernible by the human olfactory system. However, each exudable chemical compound must be discernible by at least one type of sensor that reacts when in the presence of the exudable chemical compound so that the sensor device can generate a signal that reliably indicates the presence or absence of the exudable chemical compound. Again, for aesthetic and/or security reasons, in general, the exudable chemical compounds should not be readily discernible by the human olfactory system.

In one exemplary embodiment, the exudant may be placed or embedded on the sheet of recording media 12 and/or the image carried by the sheet of recording media 12 to convey specific information regarding the characteristics of the recording media and/or the image carried by the sheet of recording media 12. For example, the one or more exudants may be placed or embedded on the sheet of recording media 12 using a type of exudant, a quantity of exudant or a spatial arrangement of exudant that conveys specific information regarding various characteristics of a sheet of recording media 12 and/or the image carried by the sheet of recording media 12. Such characteristics of a sheet of recording media 12 may include a weight of the sheet of recording media 12, the thickness of the recording media sheet 12, the quality of the sheet of recording media 12, a stiffness of the sheet of recording media 12, the grain orientation of the sheet of recording media 12, the classification of the sheet of recording media 12, a punch hole pattern of the sheet of recording media 12 and/or an orientation of the sheet of recording media 12.

Also, it should be appreciated that the sheet of recording media 12 could have exudant information placed or embedded on each surface, 14 and 16, of the sheet of recording media 12 that is the same or that is different from each other.

Figure 4:
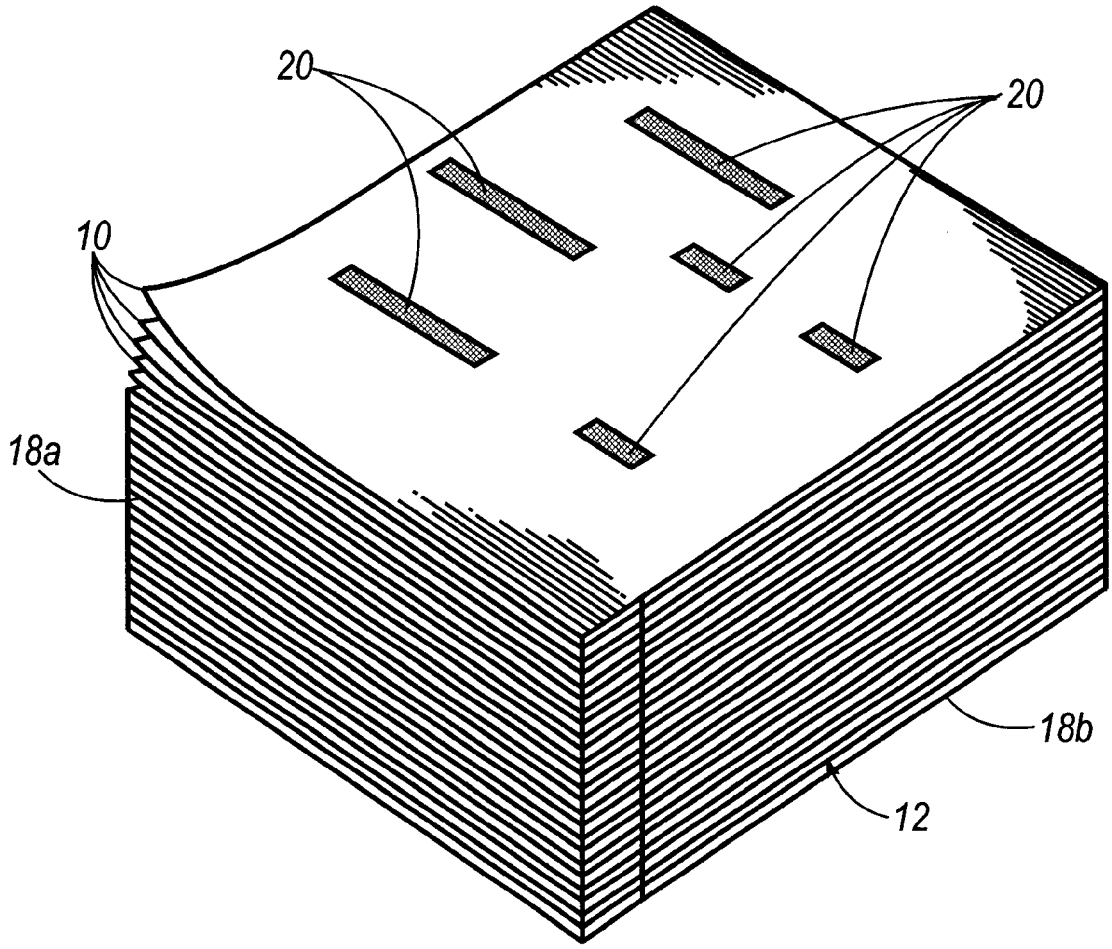
FIG. 4 is a perspective view of a stack of the recording media of FIG. 2, with encoded recording media having an identical code formed on the top surface of each individual recording media.

FIG. 4 illustrates a plurality of sheets 10, i.e., the encoded recording media, that are stacked in facial registration with one another. In FIG. 4, the various exudants that have been placed or embedded on the sheets 10 in the various locations 20 can be identical or different from one another.

In another exemplary embodiment, the exudant may be placed or embedded on the sheet 10 to provide information about an image formed on the sheet 10. For example, the one or more exudants can be placed or embedded on a sheet 10 to provide authorship and data information. Alternatively, the one or more exudants can be placed or embedded on a sheet 10 to provide file names and directory location of the image carried by the sheet 10. In complex document that has images, figures, table, quotations, and references, it may be possible to provide source information of where one or more of those items originated.

Figure 5:
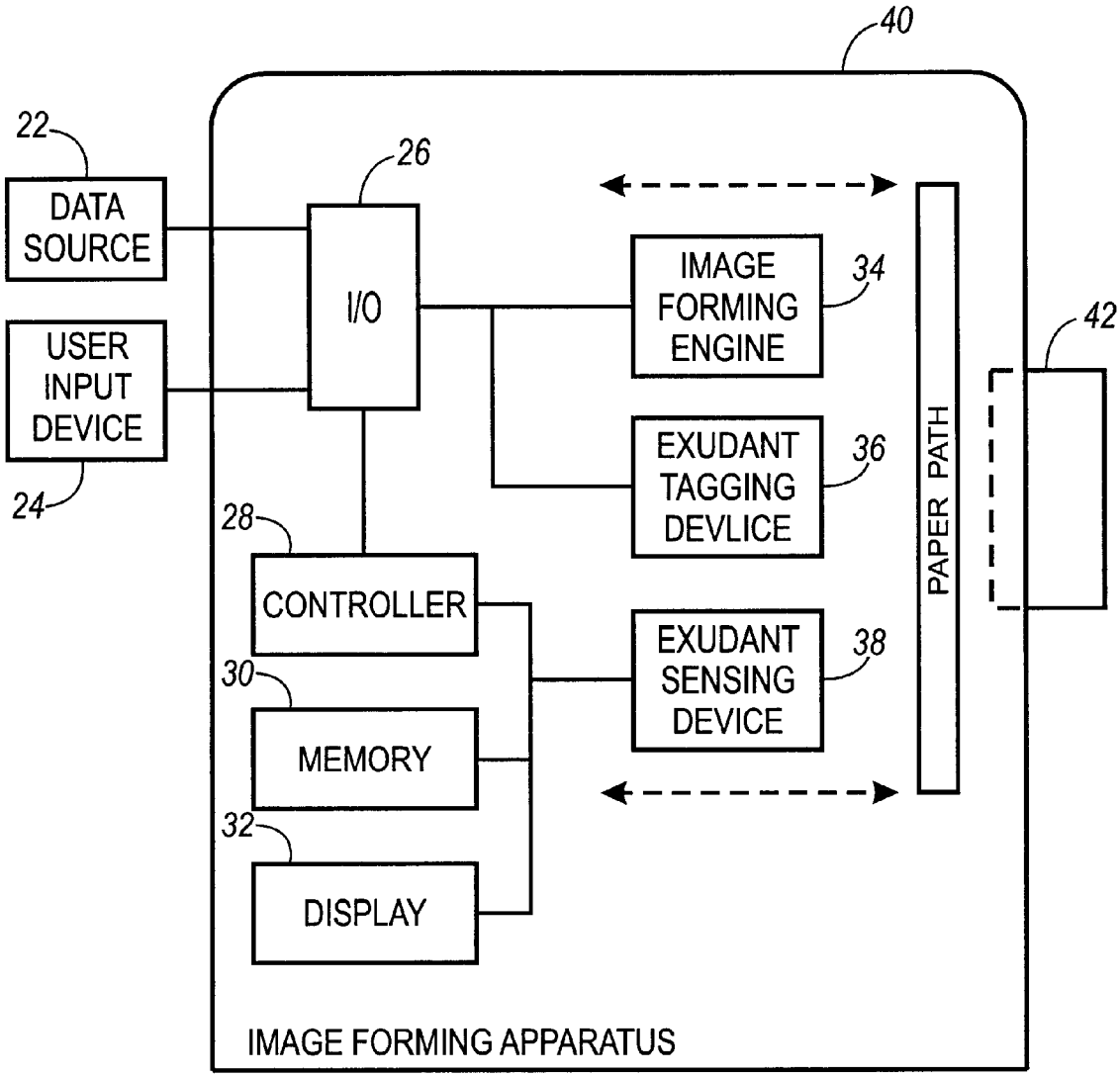
FIG. 5 is a block diagram of one exemplary embodiment of an image forming apparatus including devices usable to detect and/or apply one or more exudable chemical compounds according to this invention.

FIG. 5 is a block diagram of an image forming apparatus 40 that incorporates one or both of an exudant sensing device and an exudant tagging device according to this invention. As shown in FIG. 5, the image forming apparatus 40 forms an image on a selected type of recording media. The image forming apparatus 40 includes a first type of recording media 42, a controller 28, a memory 30, a display 32 and image forming engine 34. The image forming apparatus 40 is connectable to an image data source 22 and one or more user input devices 24. The image forming apparatus 40 can include either or both of an exudant tagging device 36 and an exudant sensing device 38. A sheet of recording media 42 usable in the image forming apparatus 40 has one or more exudants, arranged on one or more of one or more surfaces and/or one or more edges, that form a code that, in one exemplary embodiment, identifies the recording media 42 as being a specific type of material, such as paper or plastic transparency. The exudant sensing device 38 is operative in conjunction with the one or more exudants encoded on the recording media 42 to sense each different exudant or the specific locations, extents and/or combinations of the one or more exudants to generate a signal representing the encoded information.

The one or more user input devices 24 is operated by the user, in this example, to select a particular type of recording media 42 desired by the user. The controller 28 communicates with the exudant sensing device 38 and the one or more user input devices 24 to determine, in this example, whether the recording media 42 is identified as the type of recording media selected by the user. Upon determining that the recording media 42 is identified as the type of recording media selected by the user, the controller 28 causes the image forming apparatus 40 to form the image on the sheet of recording media 42.

The image forming apparatus 40 shown in FIG. 5 may also include a display 32. In this example, if the controller 28 determines that the recording media 42 can not be identified as the type of recording media selected by the user, the controller 28 can cause a message to appear on the display 32 indicating that the selected type of recording media is not available. As a result, the controller 28 prevents the image forming apparatus 40 from forming the image on the sheet of recording media 42.

The exudant sensing device 38 can include a metal oxide sensor, a conducting polymer sensor, a quartz crystal microbalance sensor, a micro-mechanical sensor, a molecular sensor and/or any other suitable known or later-developed sensor that is capable of detecting molecules of the exudant exuded from the exudant-encoded media and generating a signal dependent on the type and/or amount of exudant sensed and outputting that signal to the controller 28. It should be appreciated that the exudant sensing device 38 can include one sensor for each different chemical compound to be detected, and/or one or more sensors that can each differentially detect a number of different chemical compounds. The exudant sensing device 38 can generate the signal based on the type of exudant, the concentration of exudant or the location(s) of the exudant on the sheet. The controller 28 then converts signals from the exudant sensing device 38 into useable information.

In various exemplary embodiment, the image forming apparatus 40 shown in FIG. 5 can include the exudant tagging device 36. Each time a sheet of recording media 42 is processed, that sheet 42 may be tagged with one or more exudants to encode information onto that sheet 42. The encoded information may contain, for example, any information a user desires to place on the sheet 42. The exudant tagging device 36 may be any known or later-developed device that is capable of applying one or more exudant chemical compound to the sheet 42, such as a laser printer or a sponge-based application system, such as that described in the 300 patent.

Figure 6:
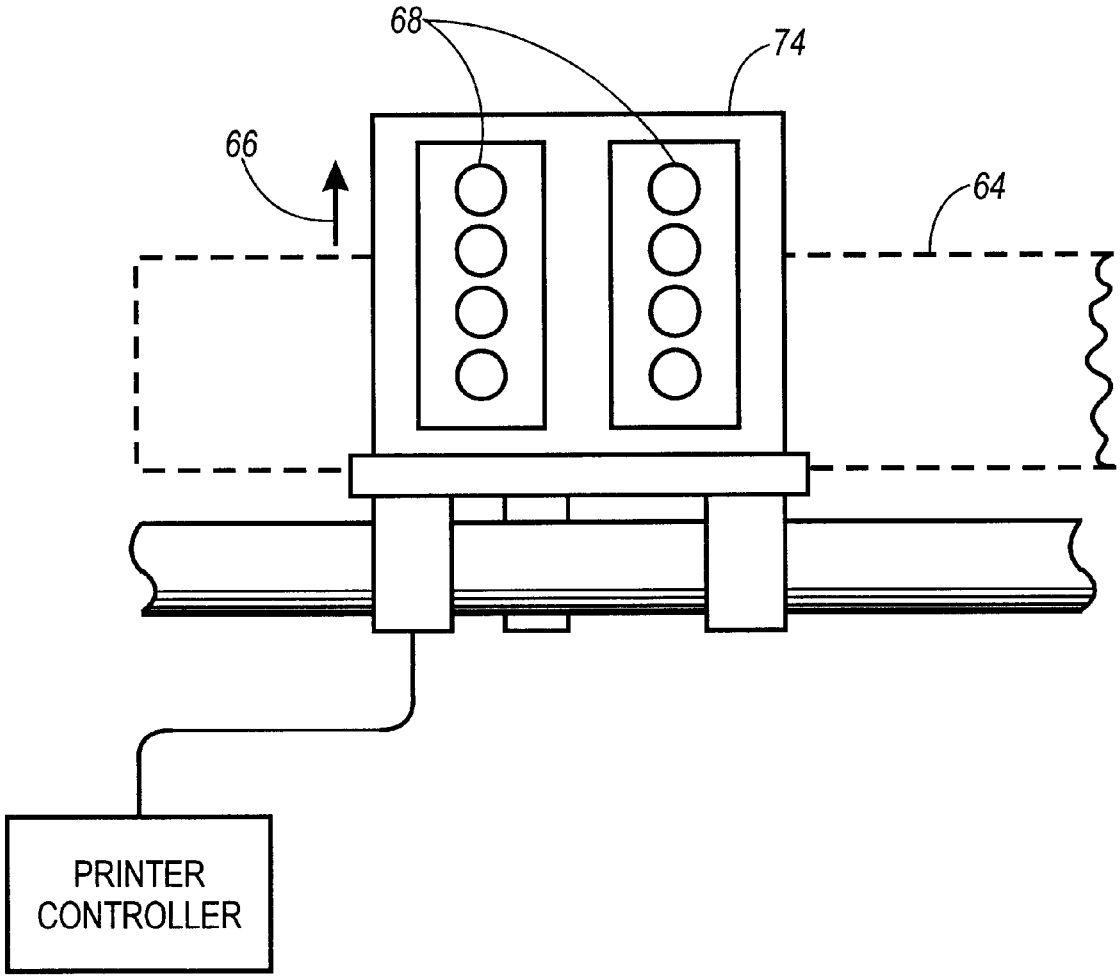
FIG. 6 illustrates an ink jet print head usable to apply one or more exudable chemical compounds according to this invention.

In one exemplary embodiment as shown in FIG. 6, the exudant tagging device 36 is an ink jet printer. The exudant is stored in an ink or toner supply cartridge 74. The exudant may be included in the ink or toner or alternatively delivered as a separate material to the receiving media 64. As the receiving media 64 passes through the printing path 66, the exudant is applied to the receiving media 64 through one or more of the nozzles 68.

In various exemplary embodiments, the exudant tagging device 36 may use an exudant that is incorporated into the toner or ink used by the image forming apparatus 40. Alternatively, the exudant can be applied separately prior to forming the image or after forming the image. In this case, the image forming apparatus 40 would have separate containers containing the exudant to be applied to the sheet of recording media 42.

In various exemplary embodiments, the one or more user input devices 24 can be used to change the type of information displayed or to request a specific type of information to be read by the exudant sensing device 38. Thus, the user may find a sheet of recording media 42 having unknown characteristics. The user may then scan the sheet of recording media 42 using the exudant sensing device 38 to determine one or more characteristics about the sheet of recording media 42, so that the sheet of recording media 42 may be identified. The user may also use the one or more user input devices 24 to input specific information to be tagged onto the sheet of recording media 42 using the exudant tagging device 36. The one or more user input devices 24 send a signal to the controller 28, which sends a signal to the exudant tagging device 36 to tag the sheet of recording media 42 with one or more exudants. For example, the user may wish to indicate that the user is the author of a document. The user then inputs the user's name through the one or more user input device 24 to instruct the controller 28 to encode the user's name on the sheet of recording media 42 using one or more exudants.

The image forming apparatus 40 can be a photocopier, a printer, a facsimile machine, an offset printing press or any other known or later-developed device that prints or otherwise forms images on the sheet of recording media 42.

Although shown in FIG. 5 as part of the image forming apparatus 40, the exudant sensing and/or tagging systems and methods of this invention may be incorporated into a variety of devices, for example, printers and facsimile machines. In various exemplary embodiments, a facsimile machine equipped with an exudant tagging device according to this invention can encode the date and time a facsimile is received using one or more exudants rather than visibly printing this information across the top of the page. A facsimile machine equipped with the exudant sensing and/or tagging systems and methods of this invention may be able to sense exudants contained in the sheet of recording media 42 and send instructions to a receiving facsimile machine to tag the recording media 42 with exudants conveying the information contained in the original document.

In various exemplary embodiments the exudant sensing and/or tagging systems and methods of this invention can stand alone as a desktop device. The exudant tagging device according to this invention may be equipped with toners or ink containing exudants or reservoirs containing exudant to be applied separately from toner or ink. The exudant sensing and/or tagging systems and methods of this invention may be used with a computer where the controller is implemented as the computer that has been provided with the necessary software.

In various other exemplary embodiments, the exudant sensing and/or tagging systems and methods of this invention is a handheld device where the user senses exudants on or embedded in a media or places tags on the media.

In another example of one exemplary use of exudant sensing and/or tagging systems and methods of this invention, a first encoded recording media are transparencies, second encoded recording media are company letterhead on bond paper, third encoded recording media are standard photocopied paper having a lefthand three hole pattern, and fourth recording media are paper card stock. Each encoded image media has an unique exudant by which it can be identified by the exudant sensing device 38 in conjunction with the controller. The user uses the one or more input devices 24 to request 20 copies of a 10-page company brochure. The user indicates that the first page of each copy is to be a transparency to be printed with the company logo. The second page is the company letterhead printed with an introductory message. Pages 3–9 are the text describing the company's services. The last page is a back cover printed with the company's name, address and phone number and that provides structural support for the remaining pages. The controller 28 can now determine if the proper media is available by reading the exudant on each media. If a type of media required is unavailable the user may be alerted. Alternatively, the user may be notified that there is an insufficient quantity of the media available. Assuming, that the media required for the job is available, it can be appreciated that the image forming apparatus 40 can now make 20 photocopies of the original 10-page company brochure without having to manually change types of the recording media or perform any manual collation.

Also, the image forming apparatus 40 may include an image recording parameters device that is operably connected with the controller 28. It is now possible that the controller 28 can change the operating parameters of the image forming apparatus 40 to facilitate printing or imaging of the particular type of recording media that has been sensed by the exudant sensing device. The image forming apparatus 40 operates in accordance with the image recording parameters. The controller 28 adjusts the image recording parameters based upon the selected type of recording media. For example, the card stock used as the fourth recording media is thicker than photocopied paper. The controller 28 is now capable of adjusting the rollers within the image forming apparatus 40 to facilitate movement of the card stock through the image process of an optimum distance between adjacent rollers.

FIG. 5 shows an image forming apparatus 40 that operates on sheets of recording media. In other exemplary embodiments, the exudants sensing and/or tagging systems and methods of the invention, the media processing apparatus can be a scanner, a sorter, a material cutting or forming device or any other type of equipment that processes or handles material.

In one exemplary embodiment of the invention, the exudant sensing and/or tagging systems and methods of the invention, the material processing apparatus includes material that is disposed in a source tray. The material includes an exudant that encodes information that is related to the material. The material processing or handling apparatus also includes at least one of an exudant sensing device 38 and/or the exudant tagging device. The material processing and/or handling apparatus may also include at least one of a controller, a memory, a display, a user input device.

It can be appreciated that the processing or handling apparatus modifies its performance capabilities based upon the encoded information related to the material. For example, upon identifying the material as a certain gage of copper, the processing or handling apparatus could adjust the size and locations of any holes to be punched in the copper. Also, it should be appreciated that the processing or handling apparatus could optimize its performance parameters based upon the encoded information related to the material. For instance, knowing the type of materials as well as the thickness, the processing or handling apparatus can adjust the amount of impact force required to punch holes in the material to reduce the consumption of power and reduce the frequency of changing the hole punches.

Finally, it should be appreciated that each type of material may have its own unique combination of one or more exudants that can be read by the exudant sensing device. The controller may then generate control signals based upon the type of material sensed to control various operations based on the type of material sensed.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An encoded exudant-containing media, comprising:

media fabricated from a material; and at least one exudable chemical compound provided at least on the media that is sensible by an exudant chemical compound sensing device, the at least one exudable chemical compound provided in a pattern that defines encoded information.

2. The encoded exudant-containing media of claim 1, wherein the pattern includes locations on the media.

3. The encoded exudant-containing media of claim 1, wherein the pattern includes combinations of the at least one exudable chemical compound.

4. The encoded exudant-containing media of claim 3, wherein the pattern includes locations on the media and combinations of at least one exudable chemical compound in the locations.

5. The encoded exudant-containing media of claim 1, wherein the at least one exudable chemical compound provided at least on the media includes the at least one exudable chemical compound provided in the media.

6. The encoded exudant-containing media of claim 1, wherein identifying information contained in the encoded information relates to at least one characteristic of the media.

7. The encoded exudant-containing media of claim 1, wherein identifying information contained in the encoded information relates to information about an image formed on the media.

8. A method of encoding a material comprising:

manufacturing a material with at least one exudable chemical compound to form at least one sensible region at least on a media, wherein the at least one sensible region defines a pattern that defines encoded information.

9. The method of claim 8, wherein the pattern includes locations on the media.

10. The method of claim 8, wherein the pattern includes combinations of the at least one exudable chemical compound.

11. The method of claim 8, wherein the pattern includes locations on the media and combinations of at least one exudable chemical compound in the locations.

12. The method of claim 8, wherein the at least one sensible region provided at least on the media includes at least one sensible region provided in the media.

13. The method of claim 8, wherein the material is a recording media.

14. A method of encoding a material comprising tagging a material with at least one exudable chemical compound to form at least one sensible region at least on a media, wherein the at least one sensible region defines sensible code information.

15. The method of claim 14, wherein the at least one sensible region provided at least on the media includes at least one sensible region provided in the media.

16. A method for handling and/or processing a material comprising:

sensing at least one exudable chemical compound which has been placed at least on the material in a pattern that defines encoded information.

17. The method of claim 16, wherein the pattern includes locations on the material.

18. The method of claim 16, wherein the pattern includes combinations of the at least one exudable chemical compound.

19. The method of claim 16, wherein the pattern includes locations on the material and combinations of at least one exudable chemical compound in the locations.

20. The method of claim 16, wherein the at least one exudable chemical compound provided at least on the material includes the at least one exudable chemical compound provided in the material.

21. The method according to claim 16, further comprising sensing the at least one exudable chemical compound with an exudable chemical compound sensing device.

22. The method according to claim 16, further comprising:

decoding information encoded using the at least one exudable chemical compound.

23. The method according to claim 22, further comprising:

processing the material based on the decoded information.

24. An apparatus for processing encoded image recording media comprising:

at least one of an exudable chemical compound sensing device and an exudable chemical compound tagging device.

25. The apparatus as claimed in claim 24, further comprising:

at least one user input device able to signal the at least one exudable chemical compound tagging device to encode information in the form of a readable exudable chemical compound pattern that defines encoded information, provided at least on an image recording media.

26. The apparatus of claim 25, wherein the readable exudable chemical compound pattern includes locations on the image recording media.

27. The apparatus of claim 25, wherein the readable exudable chemical compound pattern includes combinations of at least one exudable chemical compound on the image recording media.

28. The apparatus of claim 25, wherein the readable exudable chemical compound pattern comprises locations on the image recording media and combinations of at least one exudable chemical compound in the locations.

29. The apparatus of claim 25, wherein the at least one exudable chemical compound pattern provided at least on the image recording media includes at least one exudable chemical compound pattern provided in the image recording media.

30. The apparatus of claim 24, further comprising:

at least one user input device able to receive a signal from the at least one exudable chemical compound sensing device to output information contained in at least one readable exudable chemical compound pattern that defines encoded information, provided at least on an image recording media.

31. The apparatus of claim 30, wherein the at least one exudable chemical compound pattern provided at least on the image recording media includes at least one exudable chemical compound pattern provided in the image recording media.

32. A method of encoding an image recording media comprising:

tagging an image recording media with at least one exudable chemical compound in a pattern that defines encoded information.

33. The method of claim 32, wherein tagging the image recording media with at least one exudable chemical compound in a pattern includes placing the at least one exudable chemical compound in at least one location on the image recording media.

34. The method of claim 32, wherein tagging the image recording media with at least one exudable chemical compound in a pattern comprises placing combinations of the at least one exudable chemical compound in at least one location on the image recording media.

35. The method of claim 32, wherein tagging the image recording media with at least one exudable chemical compound in a pattern includes placing the at least one exudable chemical compound in at least one location on the image recording media and placing combinations of the at least one exudable chemical compound in at least one location on the image recording media.

36. A method of reading an encoded recording media comprising:

sensing at least one exudable chemical compound, which has been arranged in a pattern to define encoded information provided at least on the encoded recording media, with an exudable chemical compound sensing device;

deciphering the encoded information defined by the at least one exudable chemical compound pattern, and;

relating the deciphered encoded information to a user.

37. The method claim 36, wherein the pattern includes locations on the media.

38. The method claim 36, wherein the pattern includes combinations of the at least one exudable chemical compound.

39. The method of claim 36, wherein the pattern includes locations on the media and combinations of at least one exudable chemical compound in the locations.

40. The method of claim 36, wherein the encoded information provided at least on the encoded recording media includes encoded information provided in the encoded recording media.

41. An encoded exudant containing media, comprising:

media fabricated from a material; and at least one exudable chemical compound provided at least on the media, that is sensible by an exudant chemical compound sensing device, the at least one exudable chemical compound provide in a pattern that defines encoded information based on at least one of, the at least one exudable chemical compound, the quantity of the at least one exudable chemical compound and the arrangement of the at least one exudable chemical compound on the media.

* * * * *